US011338216B2

(12) United States Patent
Kogure

(10) Patent No.: US 11,338,216 B2
(45) **Date of Patent: *May 24, 2022**

(54) ASSEMBLY STRUCTURE

(71) Applicant: People Co., Ltd., Tokyo (JP)

(72) Inventor: Masako Kogure, Tokyo (JP)

( * ) Notice: Subject to any disclaimer, the term of this patent is extended or adjusted under 35 U.S.C. 154(b) by 265 days.

This patent is subject to a terminal disclaimer.

(21) Appl. No.: 16/080,667

(22) PCT Filed: Sep. 4, 2017

(86) PCT No.: PCT/JP2017/031759
§ 371 (c)(1),
(2) Date: Aug. 29, 2018

(87) PCT Pub. No.: WO2018/220874
PCT Pub. Date: Dec. 6, 2018

(65) Prior Publication Data

US 2020/0316488 A1 Oct. 8, 2020

(30) Foreign Application Priority Data

May 31, 2017 (JP) ..... 2017-108306

(51) Int. Cl.
*A63H 33/08* (2006.01)
*A63H 33/04* (2006.01)

(52) U.S. Cl.
CPC ..... *A63H 33/086* (2013.01); *A63H 33/04* (2013.01)

(58) Field of Classification Search
CPC ..... A63H 33/04; A63H 33/06; A63H 33/062; A63H 33/065; A63H 33/08; A63H 33/086
See application file for complete search history.

(56) References Cited

U.S. PATENT DOCUMENTS 3,487,579 A 1/1970 Brettingen
3,605,322 A 9/1971 Matsubayashi et al.
(Continued)

FOREIGN PATENT DOCUMENTS

CN 103505887 1/2014
CN 105363220 3/2016
(Continued)

OTHER PUBLICATIONS

International Preliminary Report on Patentability with Written Opinion dated Dec. 12, 2019 for PCT/JP2017/031759.
(Continued)

*Primary Examiner* — Eugene L Kim
*Assistant Examiner* — Alyssa M Hylinski
(74) *Attorney, Agent, or Firm* — Soei Patent & Law Firm

(57) ABSTRACT

An assembly structure includes a cylindrical part with an end closed on one side. The cylindrical part has three columnar protrusions that protrude from the end to one side and a cylindrical boss portion that is positioned within the cylindrical part such that the three protrusions of another assembly structure are fitted between the boss portion and an inner peripheral surface of the cylindrical part. The inner diameter of the cylindrical part is smaller than the sum of double the outer diameter of the protrusion and the outer diameter of the boss portion. When one protrusion of the other assembly structure is arranged on the outside of the cylindrical part, the two remaining protrusions of the other assembly structure are fitted between the boss portion and the inner peripheral surface of the cylindrical part.

20 Claims, 8 Drawing Sheets

(56) References Cited

U.S. PATENT DOCUMENTS

| | | | | |
|---|---|---|---|---|
| 4,037,978 | A | 7/1977 | Connelly | |
| 5,769,681 | A | 6/1998 | Greenwood, Sr. et al. | |
| 5,795,210 | A * | 8/1998 | Kushner | A63H 33/086 446/124 |
| 9,345,981 | B1 * | 5/2016 | Lama | A63H 33/086 |
| 10,994,218 | B2 * | 5/2021 | Kogure | A63H 33/086 |
| 2011/0045733 | A1 | 2/2011 | Saigo et al. | |
| 2013/0090033 | A1 | 4/2013 | Moura | |
| 2013/0252504 | A1 * | 9/2013 | Chang | A63H 33/086 446/124 |
| 2015/0314210 | A1 | 11/2015 | Lama et al. | |
| 2016/0346708 | A1 * | 12/2016 | Yim | A63H 33/088 |

FOREIGN PATENT DOCUMENTS

| | | |
|---|---|---|
| CN | 105980024 | 9/2016 |
| DE | 102007038883 | 2/2009 |
| GB | 2505430 | 3/2014 |
| JP | S46-014182 | 5/1971 |
| JP | S54-166995 | 11/1979 |
| JP | 2004-222858 | 8/2004 |
| JP | 2010-172568 | 8/2010 |
| JP | 2015-226748 | 12/2015 |
| JP | 2016-101219 | 6/2016 |
| JP | 2016101219 A * | 6/2016 |
| KR | 10-2014-0032118 | 3/2014 |
| WO | 95008376 | 3/1995 |

OTHER PUBLICATIONS

International Search Report dated Nov. 7, 2017 for PCT/JP2017/031759.

Extended Search Report in corresponding European Application No. 17911511.8, dated May 14, 2020.

International Search Report dated Nov. 21, 2017 for PCT/JP2017/031804.

International Preliminary Report on Patentability with Written Opinion dated Dec. 12, 2019 for PCT/JP2017/031804.

Soei Patent and Law Firm, Statement of Related Matters, dated Dec. 8, 2020.

* cited by examiner

ASSEMBLY STRUCTURE

CROSS-REFERENCE TO RELATED APPLICATIONS

This application is a U.S. National Phase patent application of PCT Application No. PCT/JP2017/031759, filed Sep. 4, 2017 which claims the benefit of priority from Japanese Patent Application No. 2017-108306, filed May 31, 2017.

TECHNICAL FIELD

One aspect of the present invention relates to an assembly structure.

BACKGROUND ART

Assembly toys with which assembly structures of various shapes can be coupled to produce arbitrary forms have attracted widespread popularity as intellect- or emotion-developing toys, among not only children but also adults. For example, Patent Literature 1 discloses an assembly structure including cylindrical parts with an end closed on one side. In the assembly structure, each of the cylindrical part has three cylindrical protrusions protruding from the end on the one side and a cylindrical boss portion within the cylindrical part. The assembly structure can be coupled to another assembly structure by fitting three protrusions of the other assembly structure between an inner peripheral surface of the cylindrical part and the boss portion.

CITATION LIST

Patent Literature

Patent Literature 1: Japanese Unexamined Patent Publication No. 2016-101219

SUMMARY OF INVENTION

Technical Problem

The assembly toy as described above has a limitation of assembly methods of the assembly structure.

One aspect of the present invention has an object to provide an assembly structure capable of various assembly methods.

Solution to Problem

An assembly structure according to one aspect of the present invention is an assembly structure including a cylindrical part with an end closed on one side. The cylindrical part has three columnar protrusions that protrude from the end to one side and a cylindrical boss portion that is positioned within the cylindrical part such that three protrusions of another assembly structure are fitted between the boss portion and an inner peripheral surface of the cylindrical part. The inner diameter of the cylindrical part is smaller than the sum of double the outer diameter of the protrusion and the outer diameter of the boss portion. When one protrusion of the other assembly structure is arranged on the outside of the cylindrical part, the two remaining protrusions of the other assembly structure are fitted between the boss portion and the inner peripheral surface of the cylindrical part.

In the assembly structure, the inner diameter of the cylindrical part is smaller than the sum of double the outer diameter of the protrusion and the outer diameter of the boss portion. That is, the outer diameter of the protrusion is larger than the distance between the inner peripheral surface of the cylindrical part and the boss portion. Therefore, when the protrusions of another assembly structure are fitted between the inner peripheral surface of the cylindrical part and the boss portion, the protrusion is sandwiched between the inner peripheral surface of the cylindrical part and the boss portion. Accordingly, the cylindrical part can be stably coupled to the cylindrical part of the other assembly structure. In addition, when one protrusion of the other assembly structure is arranged on the outside of the cylindrical part, the two remaining protrusions of the other assembly structure are fitted between the boss portion and the inner peripheral surface of the cylindrical part. In this manner, the cylindrical part can be stably coupled to the cylindrical part of the other assembly structure even by a method other than the method of fitting all three protrusions of the other assembly structure, thereby achieving various assembly methods.

In the assembly structure according to one aspect of the present invention, when two protrusions of the other assembly structure are fitted between the boss portion and the inner peripheral surface of the cylindrical part, the one remaining protrusion of the other assembly structure may be in contact with the outside of the cylindrical part. In this case, the protrusions of the other assembly structures are in contact with both the inside and outside of the cylindrical part. Accordingly, the cylindrical part can be more stably coupled to the cylindrical part of the other assembly structure.

In the assembly structure according to one aspect of the present invention, when one protrusion of the other assembly structure is arranged on the outside of the cylindrical part and the two remaining protrusions of the other assembly structure are fitted between the boss portion and the inner peripheral surface of the cylindrical part, the cylindrical part may rotate around a central axis of the cylindrical part as an axis of rotation with respect to the other assembly structure. In this case, for example, the assembly structure can further help develop children's intellect and emotion.

In the assembly structure according to one aspect of the present invention, as seen from one side, the three protrusions may be arranged such that the centers of the three protrusions constitute the peaks of a regular triangle and the central axis of the cylindrical part passes through the center of gravity of the regular triangle. In this case, it is possible to arbitrarily select two of the three protrusions of another assembly structure to be fitted between the boss portion and the inner peripheral surface of the cylindrical part.

The assembly structure according to one aspect of the present invention may include a further cylindrical part having the same shape as the cylindrical part and a connection part connecting the pair of cylindrical parts. In this case, the assembly structure includes the pair of cylindrical parts to allow further various assembly methods.

Advantageous Effects of Invention

The assembly structure according to one aspect of the present invention allows various assembly methods.

DESCRIPTION OF EMBODIMENT

An embodiment according to one aspect of the present invention will be described below in detail with reference to the accompanying drawings. In the following description, identical or equivalent elements will be given the same reference signs, and duplicated explanations thereof will be omitted.

Figure 1:
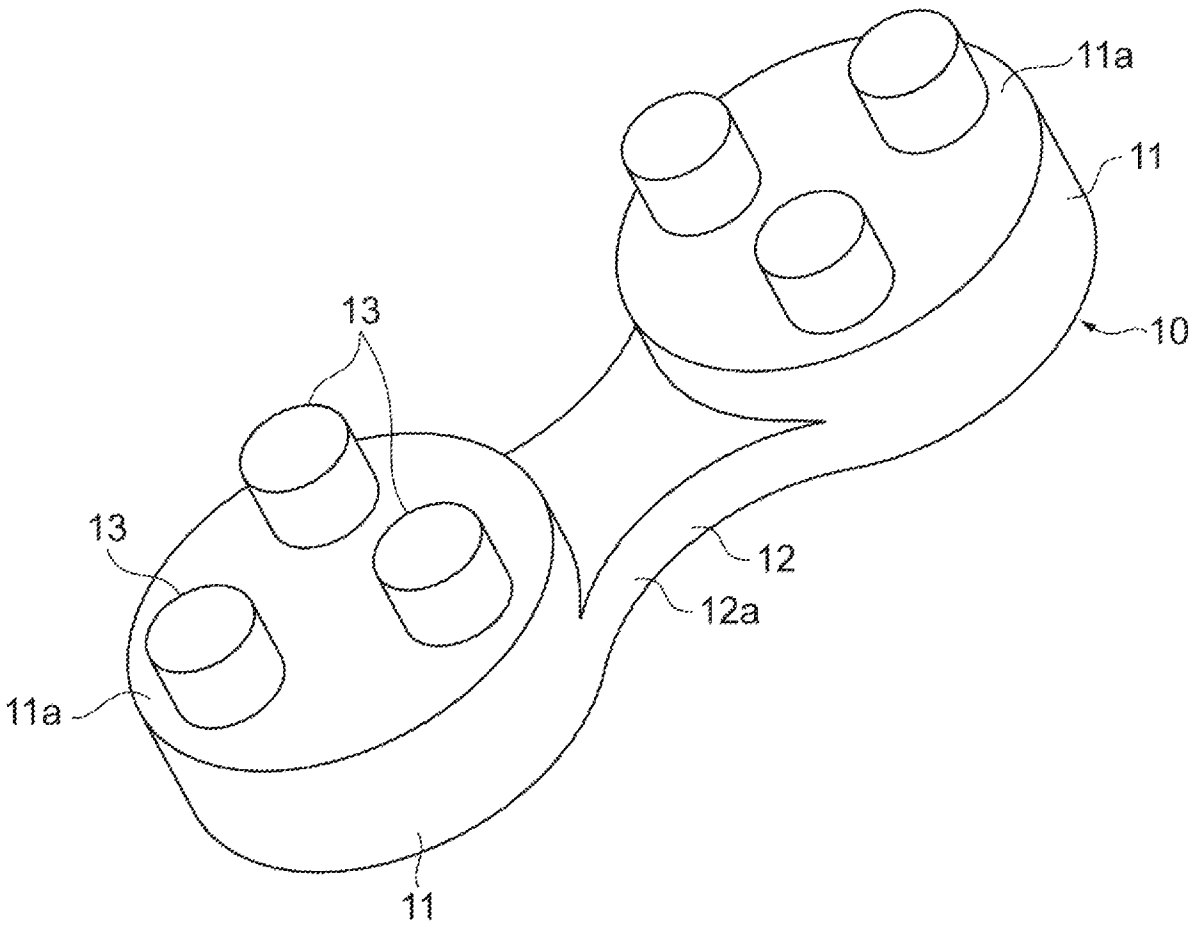
FIG. 1 is a perspective view of an assembly structure according to an embodiment seen from an obliquely upward direction.
Figure 2:
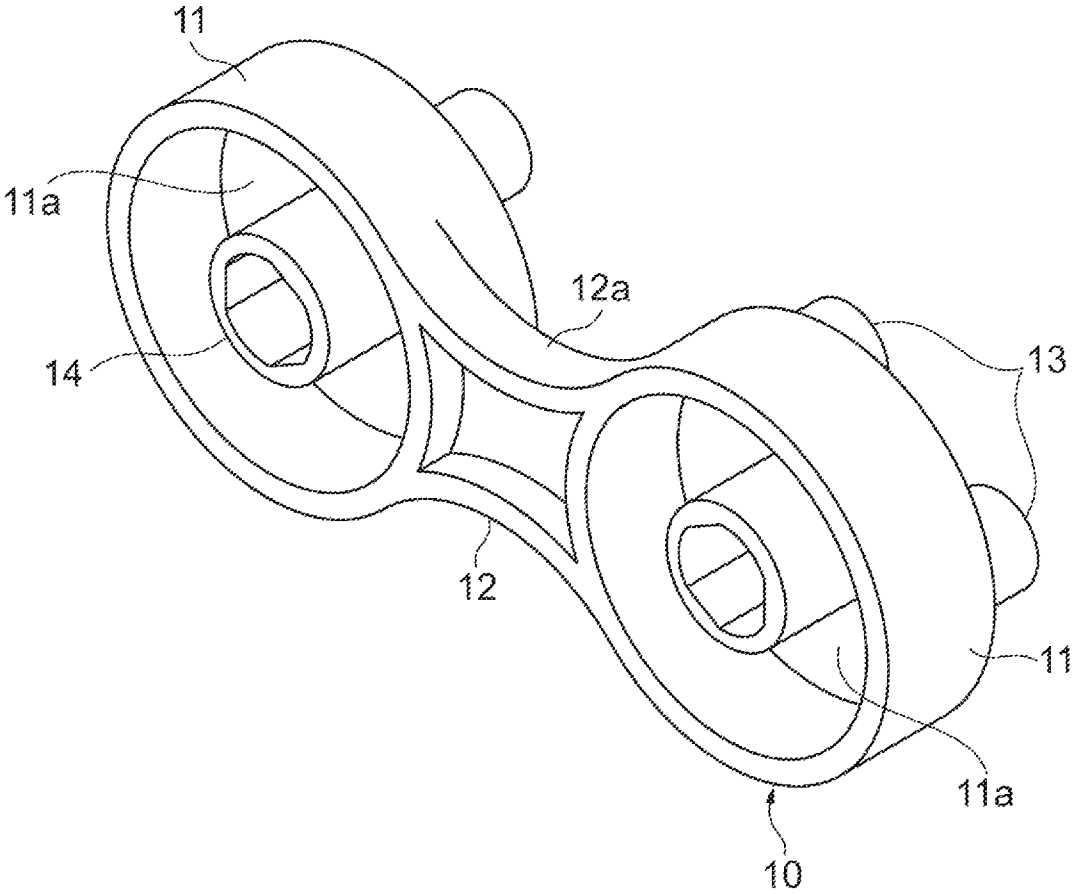
FIG. 2 is a perspective view of the assembly structure illustrated in FIG. 1 seen from an obliquely downward direction.
Figure 3:
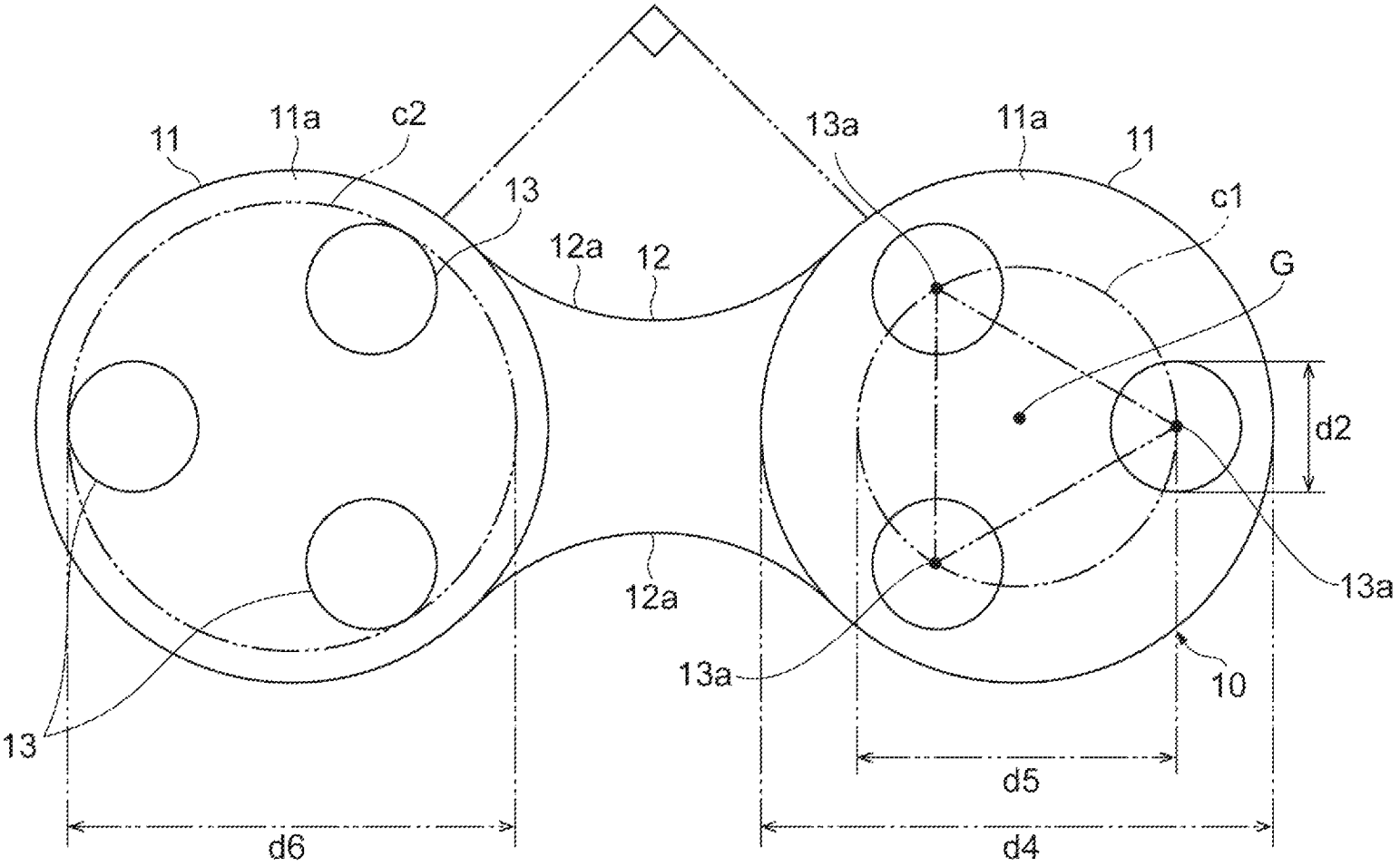
FIG. 3 is a top view of the assembly structure illustrated in FIG. 1.
Figure 4:
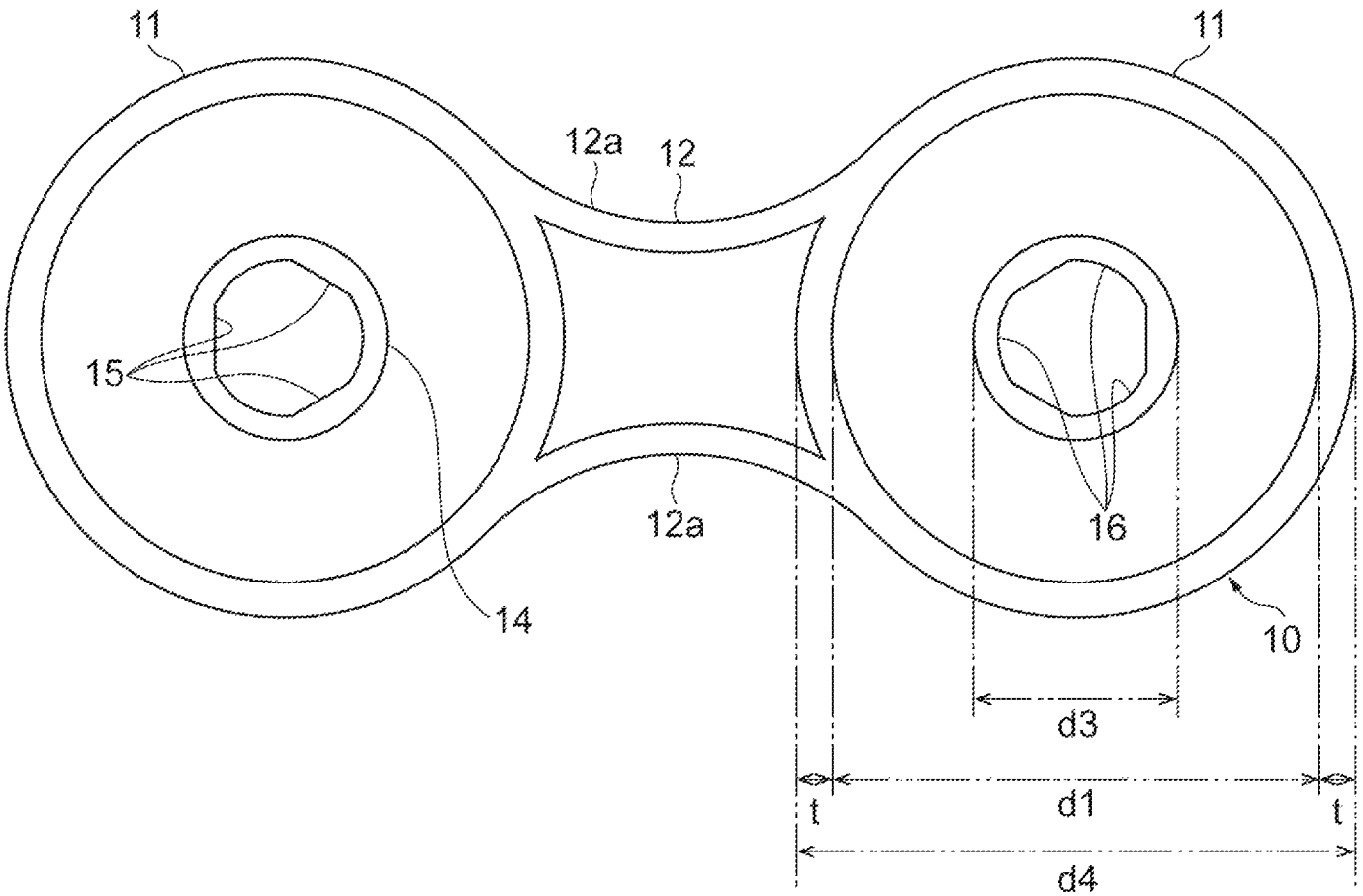
FIG. 4 is a bottom view of the assembly structure illustrated in FIG. 1.

FIG. 1 is a perspective view of an assembly structure according to one embodiment as seen from an obliquely upward direction. FIG. 2 is a perspective view of the assembly structure illustrated in FIG. 1 as seen from an obliquely downward direction. FIG. 3 is a top view of the assembly structure illustrated in FIG. 1. FIG. 4 is a bottom view of the assembly structure illustrated in FIG. 1. An assembly structure 10 according to one embodiment illustrated in FIGS. 1 to 4 is used as an assembly toy together with other assembly structures 10 to be coupled. The other assembly structures 10 have the same shape as the assembly structure 10, for example. The material for the assembly structure 10 can be selected from various viewpoints such as strength, durability, or manufacturing cost. The material for the assembly structure 10 may be a resin such as ABS resin or PLA resin, for example.

The assembly structure 10 includes a pair of cylindrical parts 11 and a connection part 12. The paired cylindrical parts 11 are cylindrical members with one end 11*a* closed in the axial direction. The paired cylindrical parts 11 have the same shape. The paired cylindrical parts 11 are arranged axially parallel to each other. The cylindrical parts 11 serve as coupling parts when the assembly structure 10 is coupled to another assembly structure 10.

The connection part 12 connects the paired cylindrical parts 11. An axial length of the connection part 12 is almost half an axial length of the cylindrical part 11. The connection part 12 has a pair of side surfaces 12*a* extending from the outer peripheral surface of one cylindrical part 11 to the outer peripheral surface of the other cylindrical part 11. The paired side surfaces 12*a* are on opposite sides from each other. Each of the paired side surfaces 12*a* is formed in a concave arc shaped face.

Each of the paired side surfaces 12*a* has an arced surface formed at a central angle of 90° with the same diameter as that of the outer peripheral surface of the cylindrical part 11. The distance between the paired side surfaces 12*a* is shortest at the middle point between the paired cylindrical parts 11. The shortest distance between the paired side surfaces 12*a* is identical to the separation distance between the paired cylindrical parts 11. Accordingly, the assembly structure 10 and another assembly structure 10 can be coupled together in a cross shape by turning the assembly structure 10 upside down relative to other assembly structure 10, rotating them 90° relative to each other, and approaching them together in such a manner that the connection parts 12 overlap each other.

Each of the cylindrical parts 11 has three protrusions 13 and a boss portion 14. The three protrusions 13 are columnar members protruding from the end 11*a* toward one axial side. In one embodiment, the protrusions 13 are hollow columnar members. Alternatively, the protrusions 13 may be solid columnar members. The three protrusions 13 have the same shape, for example. The boss portion 14 is a cylindrical member protruding from the end 11*a* toward the other axial side. The axial length of the boss portion 14 is equal to the axial length of the cylindrical part 11. The boss portion 14 has a central axis aligned to the central axis of the cylindrical part 11 and is positioned in the cylindrical part 11. To couple the assembly structure 10 to another assembly structure 10, three protrusions 13 of the other assembly structure 10 are fitted between the outer peripheral surface of the boss portion 14 and an inner peripheral surface of the cylindrical part 11 of the assembly structure 10.

Each of the boss portions 14 has three flat face portions 15 on an inner peripheral surface and three curved face portions 16 on the inner peripheral surface. The three flat face portions 15 and the three curved face portions 16 are alternately arranged in the circumferential direction of the boss portion 14. The thickness of the curved face portions 16 in the radial direction takes on a constant value, and the thickness of the flat face portions 15 in the radial direction is larger than the constant value.

In the following description, one side of the cylindrical part 11 in the axial direction will also be called the upper side and the other side in the axial direction of the same will also be called the lower side. As seen from the upper side, the three protrusions 13 are arranged such that centers 13*a* of the three protrusions 13 constitute the peaks of a regular triangle, and the center of gravity G of the regular triangle overlaps the center of the cylindrical part 11. As seen from the upper side, it can be said that the centers 13*a* of the three protrusions 13 are positioned on a virtual circle c1 centered on the center of gravity G and having a radius equal to the distance between the center of gravity G and the centers 13*a*.

Figure 5:
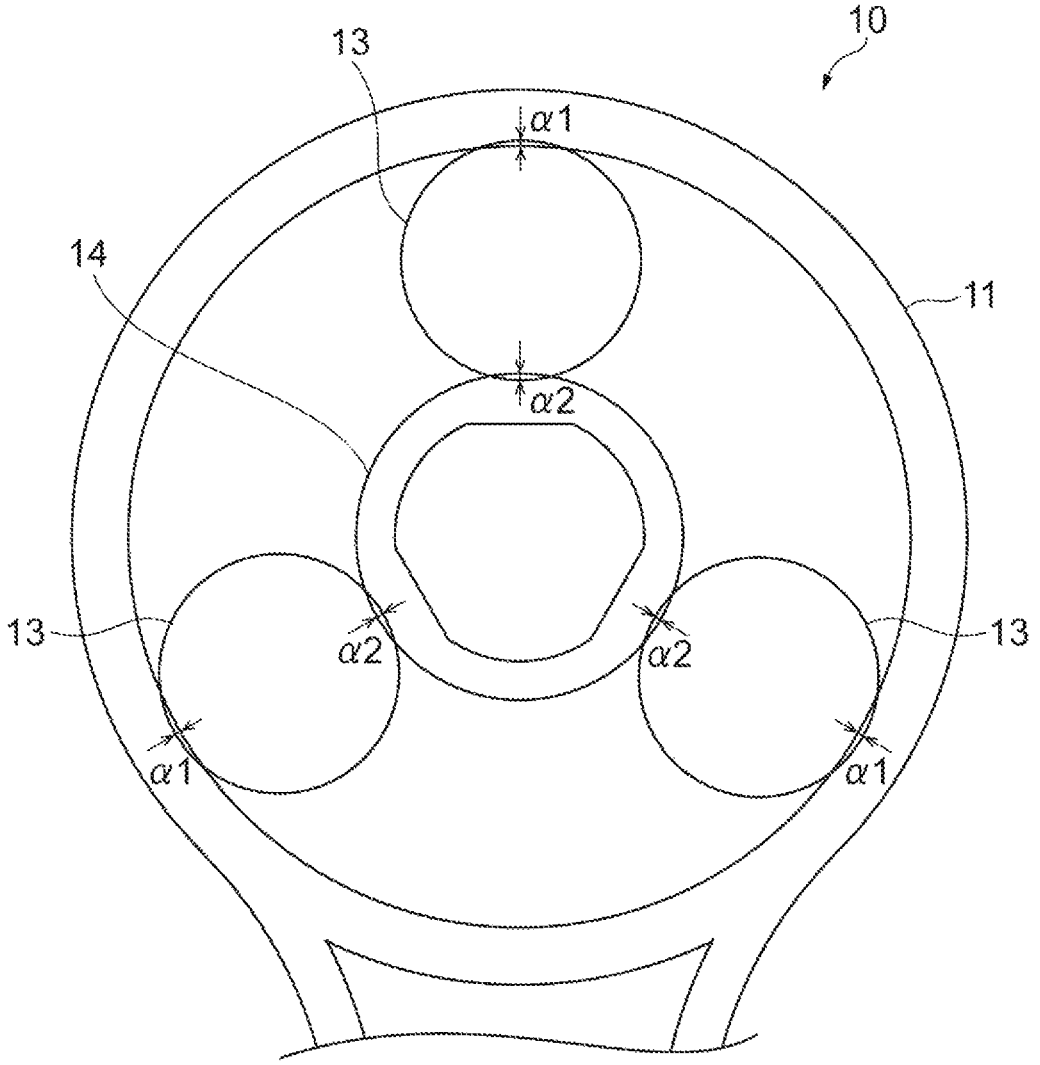
FIG. 5 is a diagram for describing interference widths.

FIG. 5 is a diagram for describing interference widths. Referring to FIG. 5, a top view of the assembly structure 10 and a bottom view of another assembly structure 10 overlap each other in such a manner that the centers of the cylindrical parts 11 align to each other. The other assembly structures 10 are the same in shape as the assembly structure 10, and thus FIG. 5 is equivalent to a view of an overlap between FIGS. 3 and 4. As illustrated in FIG. 5, the protrusions 13 of the other assembly structure 10 are formed to interfere with the inner periphery of the cylindrical part 11 and the outer periphery of the boss portion 14.

By the interferences, the inner diameter of the cylindrical part 11 is smaller than the sum of double the outer diameter of the protrusion 13 and the outer diameter of the boss portion 14. That is, in the assembly structure 10 and the other assembly structure 10 not coupled to each other as illustrated in FIGS. 3 to 5, when the inner diameter of the cylindrical part 11 is designated as d1, the outer diameter of the protrusion 13 as d2, the outer diameter of the boss portion 14 as d3, the width of a portion of the protrusion 13 in the radial direction interfering with the cylindrical part 11 (interference width) as $\alpha 1$, and the width of a portion of the protrusions 13 in the radial direction interfering with the boss portion 14 (interference width) as $\alpha 2$, d1 can be expressed as follows:

$$d1=2d2+d3-2\alpha 1-2\alpha 2$$

Therefore, when the assembly structure 10 and another assembly structure 10 are coupled to each other, the assembly structure 10 and the other assembly structure 10 deform elastically as a result of the interferences. Accordingly, the protrusions 13 of the other assembly structure 10 are sandwiched between the inner peripheral surface of the cylindrical part 11 and the outer peripheral surface of the boss portion 14, whereby the cylindrical part 11 of the assembly structure 10 can be stably coupled to the cylindrical part 11 of the other assembly structure 10. The interference widths $\alpha 1$ and $\alpha 2$ can be set to 0.02 to 0.08 mm, for example.

As illustrated in FIG. 4, when the outer diameter of the cylindrical part 11 is designated as d4 and the wall thickness (thickness in the radial direction) of the cylindrical part 11 as t, d4 can be expressed as follows:

$$d4=d1+2t$$

As illustrated in FIG. 3, when the diameter of the virtual circle c1 is designated as d5 and the diameter of a circle c2 circumscribed around the three protrusions 13 as d6, d5 and d6 can be expressed as follows:

$$d5=d4-2t-d2+2\alpha 1$$

$$d6=d1+2\alpha 1=d5+d2-2\alpha 1$$

Figure 6:
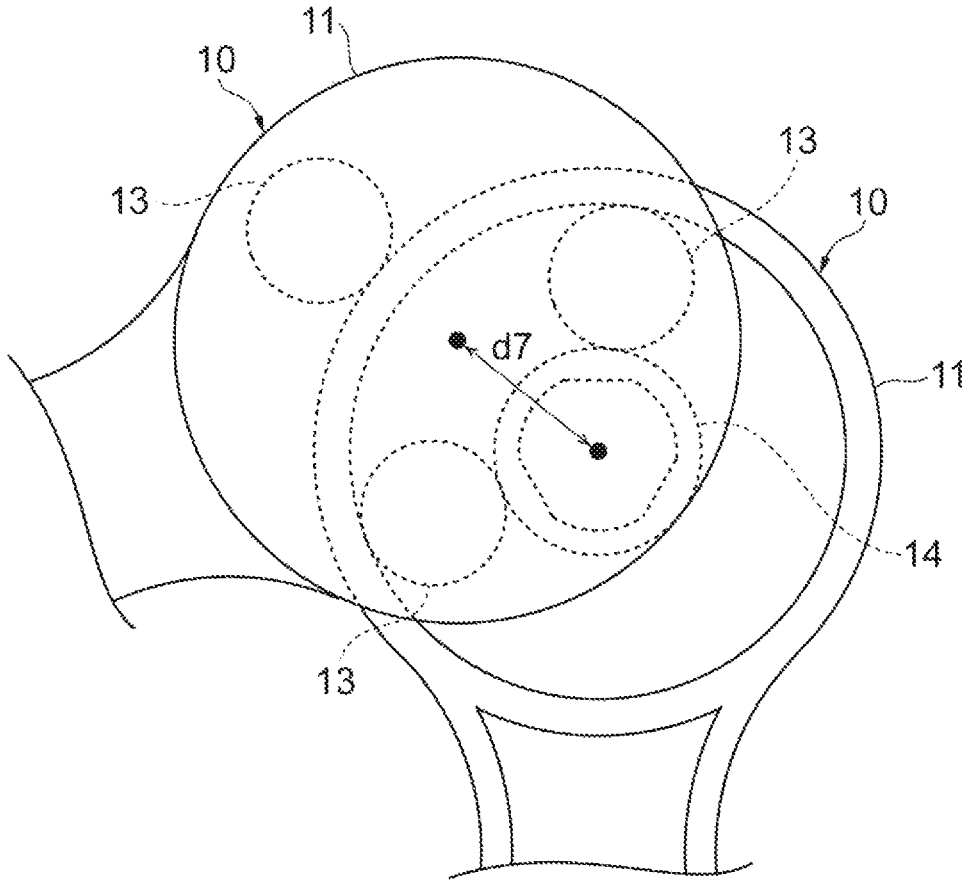
FIG. 6 is a plan view of the assembly structure coupled to another assembly structure.

FIG. 6 is a plan view of the assembly structure coupled to another assembly structure. Referring to FIG. 6, the assembly structure 10 is arranged on the lower side and the other assembly structure 10 is arranged on the upper side. As illustrated in FIG. 6, when the assembly structure 10 and the other assembly structure 10 are coupled together, one of the protrusions 13 of the other assembly structure 10 is arranged on the outside of the cylindrical part 11 of the assembly structure 10, and the two remaining protrusions 13 of the other assembly structure 10 are fitted between the outer peripheral surface of the boss portion 14 and the inner peripheral surface of the cylindrical part 11 of the assembly structure 10. In this manner, the cylindrical part 11 can be stably coupled to the cylindrical part 11 of the other assembly structure 10 by a method other than the method of fitting all three protrusions 13 of the other assembly structure 10, thereby achieving various assembly methods. Accordingly, the assembly structure 10 can help further develop children's intellect and emotion.

The dimensions can be set as follows: d1=16.08 mm, d2=4.70 mm, d3=6.73 mm, d4=18.40 mm, d5=11.4 mm, d6=16.10 mm, t=1.1 to 1.2 mm, for example.

When two of the protrusions 13 of the other assembly structure 10 are fitted between the boss portion 14 and the inner peripheral surface of the cylindrical part 11, the one remaining protrusion 13 of the other assembly structure 10 is in contact with the outer periphery of the cylindrical part 11 of the assembly structure 10. In this manner, the three protrusions 13 of the other assembly structure 10 are in contact with both the inside and outside of the cylindrical part 11 of the assembly structure 10. Accordingly, the cylindrical part 11 of the assembly structure 10 can be coupled more stably to the cylindrical part 11 of the other assembly structure 10.

When one of the protrusions 13 of the other assembly structure 10 is arranged on the outside of the cylindrical part 11 of the assembly structure 10 and the two remaining protrusions 13 of the other assembly structure 10 are fitted between the outer peripheral surface of the boss portion 14 and the inner peripheral surface of the cylindrical part 11 of the assembly structure 10, the cylindrical part 11 rotates around the central axis of the cylindrical part 11 as an axis of rotation with respect to the other assembly structure 10. In this case, as seen from the upper side, center-to-center distance d7 between the cylindrical part 11 of the assembly structure 10 and the cylindrical part 11 of another assembly structure 10 is equal to the center-to-center distance between the cylindrical part 11 and the protrusion 13, that is, the radius of the virtual circle c1 (d5/2).

Figure 7:
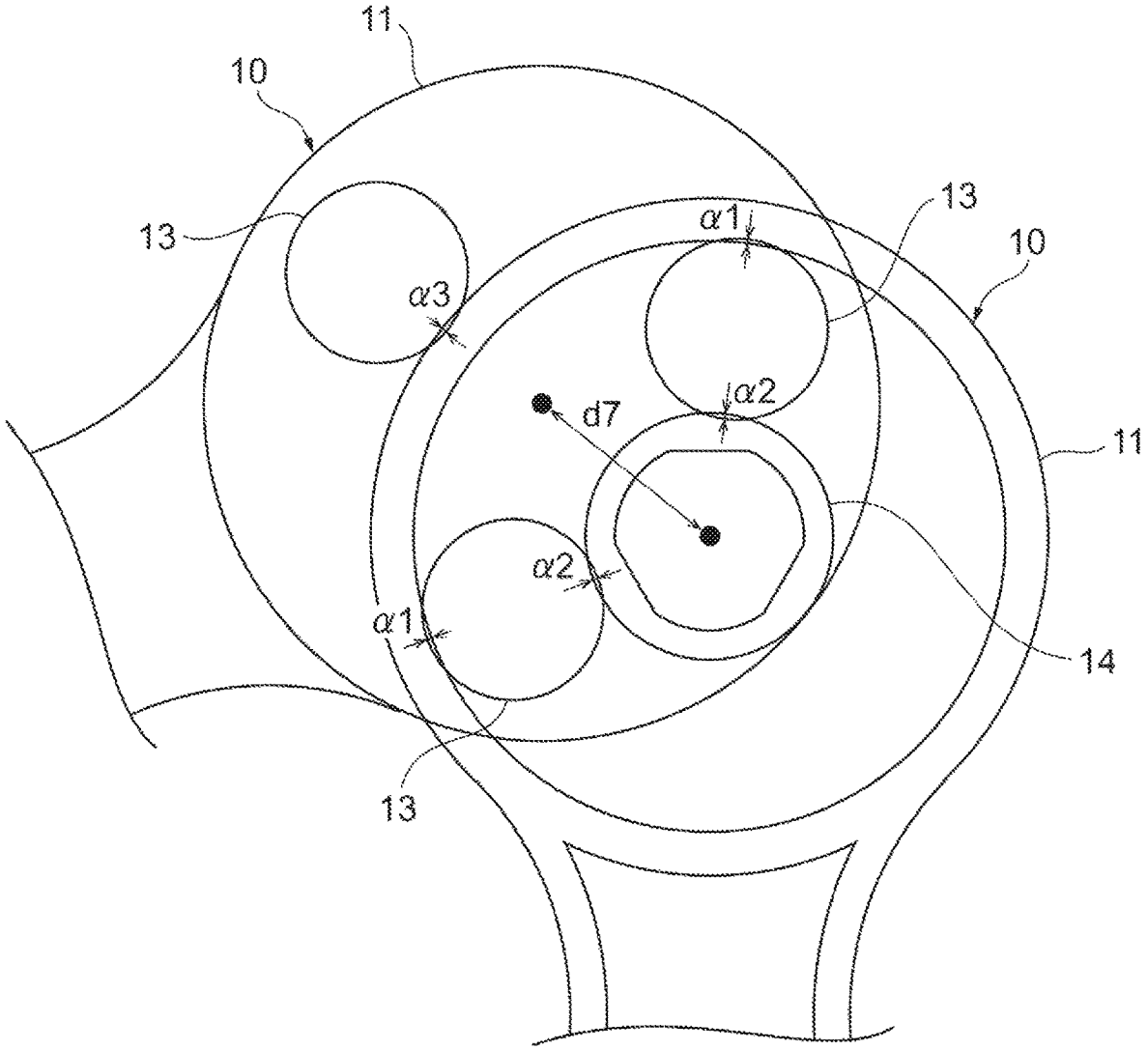
FIG. 7 is a diagram for describing interference widths.

FIG. 7 is a diagram for describing interference widths. Referring to FIG. 7, a top view of the assembly structure 10 and a bottom view of another assembly structure 10 overlap each other. The assembly structure and the other assembly structure illustrated in FIG. 7 are not yet coupled to each other. As illustrated in FIG. 7, one of the protrusions 13 of the other assembly structure 10 is formed to interfere with the outer periphery of the cylindrical part 11 of the assembly structure 10. When the interference width is designated as $\alpha 3$ and d7 is equal to d5/2 as described above, the following relation holds. The interference width $\alpha 3$ can be set to 0.02 to 0.08 mm, for example.

$$d4/2=d5-d2/2+\alpha 3$$

where d4/2 corresponds to the radius of the outer peripheral surface of the cylindrical part 11, d5 to double the center-to-center distance d7, and d2/2 corresponds to the radius of the outer peripheral surface of the protrusion 13.

The present invention is not limited to the foregoing embodiment but can be modified in various manners.

Figure 8:
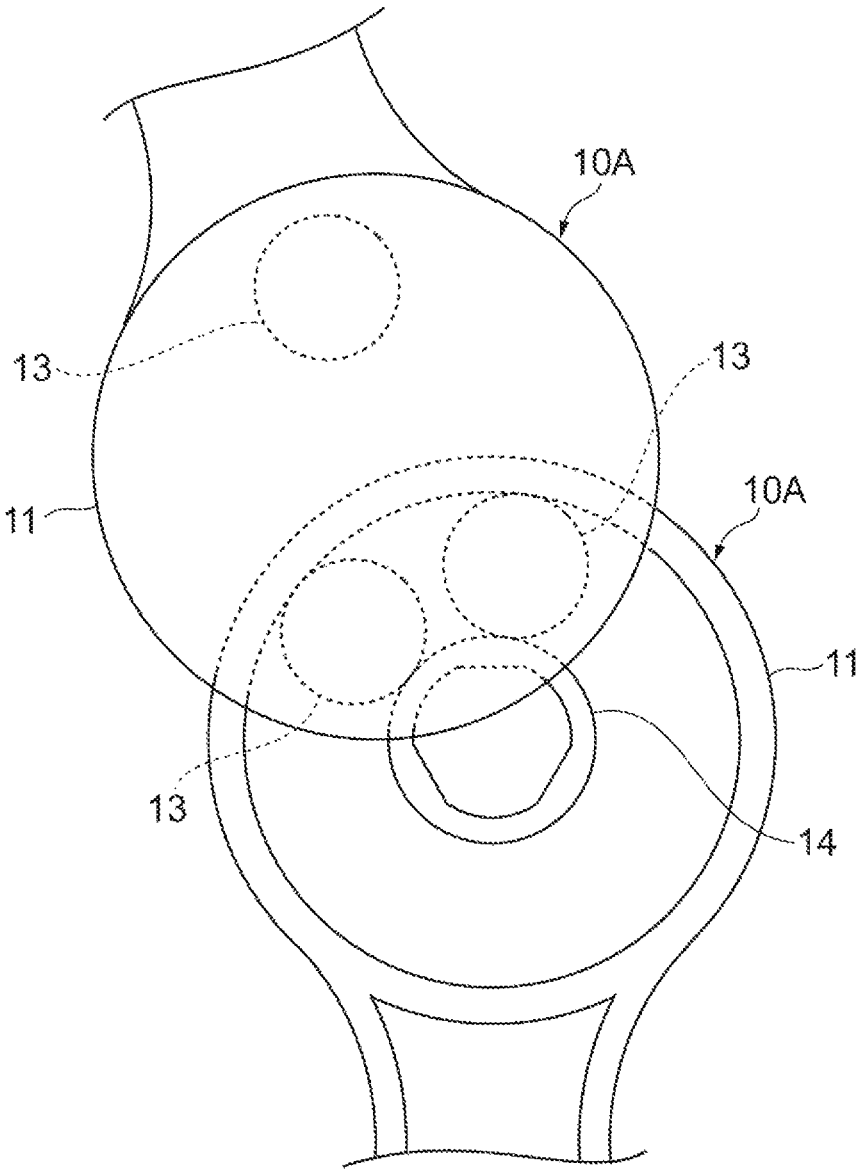
FIG. 8 is a plan view of an assembly structure coupled to another assembly structure according to an example modification.

FIG. 8 is a plan view of an assembly structure coupled to another assembly structure according to a modification example. As illustrated in FIG. 8, an assembly structure 10A according to the example modification is different from the assembly structure 10 in the arrangement of the three protrusions 13. In the assembly structure 10A as well, when one of protrusions 13 of another assembly structure 10A is arranged on the outside of the cylindrical part 11 of the assembly structure 10A, the two remaining protrusions 13 of the other assembly structure 10A are fitted between the outer peripheral surface of the boss portion 14 and the inner peripheral surface of the cylindrical part 11 of the assembly structure 10A. In this manner, in the assembly structure 10A as well, the cylindrical part 11 can be stably coupled to the cylindrical part 11 of the other assembly structure 10A by a method other than the method of fitting all three protrusions 13 of the other assembly structure 10A, thereby achieving various assembly methods.

Each of the assembly structures 10 and 10A includes at least one cylindrical part 11.

REFERENCE SIGNS LIST

10, 10A Assembly structure
11 Cylindrical part
12 Connection part
13 Protrusion
14 Boss portion

The invention claimed is:

1. An assembly having a plurality of removably attachable assembly structures, the assembly comprising:

a first assembly structure including a first cylindrical part and a cylindrical boss portion that is located within the first cylindrical part;

a second assembly structure identical to the first assembly structure, including a second cylindrical part with a closed end and three columnar protrusions that protrude from the closed end, wherein central axes of the three columnar protrusions are located on a virtual circle having a center point aligned with a central axis of the second cylindrical part;

wherein, in a first assembly configuration, the three columnar protrusions of the second assembly structure are configured to be fitted between an outer peripheral surface of the cylindrical boss portion and an inner peripheral surface of the first cylindrical part of the first assembly structure, wherein a diameter d5 of the virtual circle of the second assembly structure is designated by an equation $d5=d4-2t-d2+2\alpha1$, where d2 corresponds to each diameter of the three columnar protrusions, d4 corresponds to an outer diameter of the second cylindrical part, t corresponds to an annular wall thickness of the second cylindrical part, and in the first assembly configuration $\alpha1$ corresponds to a width of a portion of one of the three columnar protrusions that interferes with the first cylindrical part in a radial direction, wherein d4−2 t, corresponding to an inner diameter of the second cylindrical part, is smaller than a sum of 2 d2+d3, where d3 corresponds to an outer diameter of the cylindrical boss portion, wherein an inner peripheral surface of the cylindrical boss portion of the first assembly structure comprises a plurality of flat face portions that alternate with and are connected between a plurality of arced face portions forming concave surfaces that face a center of the cylindrical boss portion, and a wall thickness of the cylindrical boss portion increases from a minimum value at the plurality of arced face portions to a maximum value at the plurality of flat face portions, and wherein, in the first assembly configuration, the three columnar protrusions of the second assembly structure are configured to be fitted adjacent to the outer peripheral surface of the cylindrical boss portion of the first assembly structure, opposite to the plurality of flat face portions, where the wall thickness is at the maximum value.

2. The assembly according to claim 1, wherein, when two of the three columnar protrusions of the second assembly structure are fitted between the outer peripheral surface of the cylindrical boss portion and the inner peripheral surface of the first cylindrical part in a second assembly configuration, one of the three columnar protrusions remains in contact with an outside surface of the first cylindrical part.

3. The assembly according to claim 1, wherein the three columnar protrusions are further configured to be fitted to the first assembly structure in a second assembly configuration, such that when one of the three columnar protrusions of the second assembly structure is arranged on an outside surface of the first cylindrical part, and two of the three columnar protrusions of the second assembly structure are fitted between the cylindrical boss portion and the inner peripheral surface of the first cylindrical part, the first cylindrical part of the first assembly structure is configured to rotate around a central axis of the second cylindrical part of the second assembly structure as an axis of rotation.

4. The assembly according to claim 1, wherein, in a plan view, centers of the three columnar protrusions constitute peaks of a regular triangle, and wherein the central axis of the second cylindrical part passes through a center of gravity of the regular triangle.

5. The assembly according to claim 1, wherein the first assembly structure comprises a pair of identical cylindrical parts, including the first cylindrical part, and a connection part connecting the pair of identical cylindrical parts.

6. The assembly according to claim 3, wherein, when the two of the three columnar protrusions are fitted between the cylindrical boss portion and the inner peripheral surface of the first cylindrical part in the second assembly configuration, a distance d7 between the central axis of the first cylindrical part and the central axis of the second cylindrical part is equal to half of the diameter d5.

7. An assembly comprising a first assembly structure and a second assembly structure, each of the first and second assembly structures including a first end and a second end, wherein the first end includes:

a cylindrical body;

a circular wall closing one end of the cylindrical body and forming a cavity within the cylindrical body;

three columnar protrusions protruding from the circular wall; and a cylindrical boss located within the cavity of the cylindrical body, the cylindrical boss protruding from the circular wall in an opposite direction from the three columnar protrusions, wherein the cylindrical boss includes a plurality of flat faces that are alternately arranged with and connected to a plurality of curved faces to form an inner peripheral surface of the cylindrical boss in a circumferential direction, wherein the cylindrical boss comprises an annular wall formed between the inner peripheral surface and an outer peripheral surface of the cylindrical boss, the annular wall having a first thickness between the plurality of flat faces and the outer peripheral surface, and a second thickness between the plurality of curved faces and the outer peripheral surface, the second thickness smaller than the first thickness, and wherein, in a first assembly configuration in which the first end of the first assembly structure is directly coupled to the first end of the second assembly structure, the three columnar protrusions of the first assembly structure contact the outer peripheral surface of the cylindrical boss of the second assembly structure, adjacent to the plurality of flat face portions of the second assembly structure, where the annular wall has the first thickness.

8. The assembly according to claim 7, wherein, in a second assembly configuration in which the first assembly structure is configured to be detachably coupled to the second assembly structure, one of the three columnar protrusions of the first assembly structure is located outside of a second cylindrical body of the second assembly structure, and two of the three columnar protrusions of the first assembly structure are fitted between a cylindrical boss of the second assembly structure and an inner peripheral surface of the second cylindrical body.

9. The assembly according to claim 8, wherein, in the second assembly configuration, the one of the three columnar protrusions contacts an outer peripheral surface of the second cylindrical body.

10. The assembly according to claim 9, wherein, in the second assembly configuration, the cylindrical body is configured to rotate around a central axis of the second cylindrical body.

11. The assembly according to claim 7, wherein, in a plan view, centers of the three columnar protrusions constitute peaks of a regular triangle, and wherein a central axis of the cylindrical body passes through a geometric center of the regular triangle.

12. The assembly according to claim 7, wherein the annular wall comprises a cylindrical-shaped external peripheral surface formed at a fixed radius with respect to a center of the cylindrical boss.

13. The assembly according to claim 7, wherein the plurality of curved faces form concave surfaces that face a center of the cylindrical boss.

14. An assembly structure comprising:

a cylindrical body;

a circular wall closing one end of the cylindrical body and forming a cavity within the cylindrical body;

three columnar protrusions protruding from the circular wall; and a cylindrical boss located within the cavity of the cylindrical body, the cylindrical boss protruding from the circular wall in an opposite direction from the three columnar protrusions, wherein the cylindrical boss includes an inner peripheral surface and an external peripheral surface, the inner peripheral surface including a plurality of flat portions that are alternately arranged with and connected to a plurality of curved portions in a circumferential direction along the inner peripheral surface of the cylindrical boss, wherein the plurality of curved portions form concave surfaces that face a center of the cylindrical boss, wherein the cylindrical boss has a variable wall thickness that includes a first thickness measured between the plurality of flat portions and the external peripheral surface, and a second thickness measured between the concave surfaces and the external peripheral surface, the second thickness smaller than the first thickness, and wherein, when the assembly structure is directly coupled to a second assembly structure having an identical structure as the assembly structure in a first assembly configuration, the three columnar protrusions of the assembly structure are fitted adjacent to an outer peripheral surface of a second cylindrical boss of the second assembly structure, opposite to a plurality of flat face portions of the second assembly structure, where a wall thickness of the second cylindrical boss of the second assembly structure is at a maximum value.

15. The assembly structure according to claim 14, wherein the external peripheral surface of the cylindrical boss forms a cylindrical-shaped surface having a fixed radius with respect to the center of the cylindrical boss.

16. The assembly structure according to claim 14, wherein, in a second assembly configuration in which the assembly structure is configured to be detachably coupled to the second assembly structure, one of the three columnar protrusions of the assembly structure is located outside of a second cylindrical body of the second assembly structure, and two of the three columnar protrusions of the assembly structure are fitted between the second cylindrical boss of the second assembly structure and an inner peripheral surface of the second cylindrical body.

17. The assembly structure according to claim 16, wherein, in the second assembly configuration, the one of the three columnar protrusions contacts an outer peripheral surface of the second cylindrical body.

18. The assembly structure according to claim 17, wherein, in the second assembly configuration, the cylindrical body is configured to rotate around a central axis of the second cylindrical body.

19. The assembly structure according to claim 14, wherein, in a plan view, centers of the three columnar protrusions constitute peaks of a regular triangle, and wherein a central axis of the cylindrical body passes through a geometric center of the regular triangle.

20. The assembly according to claim 1, wherein a cylindrical-shaped external peripheral surface of the cylindrical boss portion of the first assembly structure is formed at a fixed radius with respect to the center of the cylindrical boss portion, and wherein the wall thickness of the cylindrical boss portion is measured between the cylindrical-shaped external peripheral surface and the inner peripheral surface.

* * * * *